US005747230A

United States Patent [19]

Bee et al.

[11] Patent Number: 5,747,230

[45] Date of Patent: May 5, 1998

[54] PHOTOGRAPHIC SILVER HALIDE COLOUR MATERIAL HAVING IMPROVED GRANULARITY AND DYE HUE

[75] Inventors: John Arthur Bee, Carpenders Park; John Kenneth Charles Kempster, Stanmore; Gareth Evans, Hollybush Close, all of England

[73] Assignee: Eastman Kodak Company, Rochester, N.Y.

[21] Appl. No.: 577,636

[22] Filed: Dec. 22, 1995

[30] Foreign Application Priority Data

Dec. 24, 1994 [GB] United Kingdom ..... 9426277
Oct. 14, 1995 [GB] United Kingdom ..... 9521088

[51] Int. Cl.[6] ..... G03C 1/46

[52] U.S. Cl. ..... 430/503; 430/502; 430/505; 430/543; 430/567; 430/570; 430/572; 430/584; 430/599; 430/600; 430/642

[58] Field of Search ..... 430/502, 503, 430/505, 543, 567, 642, 570, 572, 584, 599, 600

[56] References Cited

U.S. PATENT DOCUMENTS

| | | | |
|---|---|---|---|
| 3,674,490 | 7/1972 | Matejec | 96/48 |
| 3,989,526 | 11/1976 | Bissonette | 96/48 |
| 4,022,616 | 5/1977 | Barr et al. | 96/20 |
| 4,146,397 | 3/1979 | Shimamura et al. | 96/60 |
| 4,471,049 | 9/1984 | King et al. | 430/504 |
| 4,816,290 | 3/1989 | Heki et al. | 430/642 |
| 5,063,143 | 11/1991 | Hirose et al. | 430/419 |
| 5,591,568 | 1/1997 | Bagchi et al. | 430/546 |

FOREIGN PATENT DOCUMENTS

| | | |
|---|---|---|
| 0 447 656 | 9/1991 | European Pat. Off. . |
| 0 545 305 | 6/1993 | European Pat. Off. . |
| 0 605 917 A3 | 7/1994 | European Pat. Off. . |
| 0 616 255 A1 | 9/1994 | European Pat. Off. . |
| 53143323 | 12/1978 | Japan . |
| 1403418 | 8/1975 | United Kingdom . |
| 1560572 | 2/1980 | United Kingdom . |
| 93/03418 | 2/1993 | WIPO . |

OTHER PUBLICATIONS

*Introduction to Photographic Theory, The Silver Halide Process*, by B. H. Carroll, G. C. Higgins and T. H. James, John Wiley & Sons (1980, reprinted in 1986) pp. 27–32.

*Research Disclosure*, vol. 366, No. 03, Oct., 1994.

*Primary Examiner*—Geraldine Letscher
*Attorney, Agent, or Firm*—Edith A. Rice

[57] ABSTRACT

A photographic silver halide color print material comprising a support and yellow, magenta and cyan dye image forming layer units comprising at least one silver halide emulsion layer and at least one dye image-forming coupler which material contains a total silver halide coating weight less than 150 mg/m$^2$ (as silver) and wherein the grain size (average volume in cubic microns) of the emulsion(s) is less than 1.0 (μm)$^3$ in the yellow image forming unit and less than 0.125 (μm)$^3$ in the magenta image forming unit and wherein each layer unit of the material has a dye image-forming efficiency (E) under conditions of use of above 30 where:

$$E = \frac{\text{Dye image Dmax}}{\text{Silver coverage (g/m}^2\text{)}}$$

wherein the emulsion(s) of the cyan dye image forming layer unit have a silver coating weight less than 50 mg/m$^2$, and an average grain size less than 0.064 (μm)$^3$ and comprise means for increasing the speed of the cyan dye image forming unit emulsion(s) to a level sufficient to provide a cyan image having the desired neutral color balance relationship with the yellow and magenta images formed on exposure and processing.

13 Claims, 1 Drawing Sheet

PHOTOGRAPHIC SILVER HALIDE COLOUR MATERIAL HAVING IMPROVED GRANULARITY AND DYE HUE

FIELD OF THE INVENTION

This invention relates to photographic silver halide materials containing low laydowns of silver halide having improved granularity and dye hue.

BACKGROUND OF THE INVENTION

There has been a trend to reduce the amount of silver contained by photographic materials. There are various reasons why this has been done and these include reducing the cost, reducing the thickness of silver halide emulsion layers, gaining sharpness, and reducing the environmental impact.

One class of low silver photographic materials are colour materials intended for redox amplification processes wherein the developed silver acts as a catalyst to the formation of dye image.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image.

Oxidised colour developer reacts with a colour coupler to form the image dye. The amount of dye formed depends on the time of treatment or the availability of colour coupler and is less dependent on the amount of silver in the image as is the case in conventional colour development processes.

These materials could be films or papers, of the negative or reversal type. The dyes could be chromogenic dyes formed from oxidised colour developing agent and colour couplers, dyes which can be produced by different chemical processes or dye released from dye releasers by oxidised developer. It particularly relates to materials used for colour prints from negatives using a chromogenic process of dye formation.

In conventional chromogenic imaging, the efficiency with which dye is formed from oxidised developer can often be low. Even when on a stoichiometric basis, the nominal requirement for oxidised developer is for a single molecule to couple with a so-called 2-equivalent coupler. There are often several sources of inefficiency which lead to higher requirements and thus higher silver levels. When two oxidised developer molecules are needed as with 4-equivalent couplers the silver needed is greater still. It is often the case that in practice these factors combine so that perhaps 6 or 7 silver ions are required to be reduced to form a single dye molecule.

For any one image-forming unit in a photographic material it is possible to derive a value for the efficiency of dye image production (E). This value can be calculated using the formula:

$$E = \frac{\text{Dye image } D_{max}}{\text{Silver coverage (g/m}^2\text{)}}.$$

Typical values of E for conventional silver halide colour materials are in the 5 to 25 range but could be higher as the technology improves.

With redox (RX) development which uses developed silver surfaces to catalyse the oxidation of developer, the normal relationship between image dye amounts and the amounts of silver halide developed is broken. It is still possible, however, to derive a value for dye image production efficiency under any given set of circumstances.

Photographic materials described for use in such redox amplification processes have been multilayer colour materials with layers sensitive to different regions of the spectrum.

It is highly desirable to reduce silver levels not only to save on manufacturing costs but also for the reduced environmental impact of the process. However merely reducing the silver halide laydown will result in the number of silver centres contributing to an image being reduced to a point at which the consequences of the silver halide reduction are visible in the image. Such consequences may be seen as increased half bandwidth, unwanted spectral absorptions and increased granularity of the dye image.

PROBLEM TO BE SOLVED

The problem that the present invention seeks to solve is how to reduce granularity in low silver halide coverage materials without increasing the silver halide laydown. This problem is unique to low silver halide laydown materials and has never been a significant problem in photographic materials having conventional (higher) silver halide coating weights.

Another problem that the present invention seeks to solve is how to improve dye hue (by narrowing the half bandwidth and reducing unwanted absorptions) in low silver halide coverage materials without increasing the silver halide laydown. This problem is again particularly applicable to low silver halide laydown materials and has never been a significant problem in photographic materials having conventional (higher) silver halide coating weights.

SUMMARY OF THE INVENTION

According to the present invention there is provided a photographic silver halide colour print material comprising a support and yellow, magenta and cyan dye image forming layer units comprising at least one silver halide emulsion layer and at least one dye image-forming coupler which material contains a total silver halide coating weight less than 150 mg/m$^2$ (as silver) and wherein the grain size (average volume in cubic microns) of the emulsion(s) is less than 1.0(μm)$^3$ in the yellow image forming unit and less than 0.125(μm)$^3$ in the magenta image forming unit and wherein each layer unit of the material has a dye image-forming efficiency (E) under conditions of use of above 30 where:

$$E = \frac{\text{Dye image Dmax}}{\text{Silver coverage (g/m}^2\text{)}}$$

characterized in that the emulsion(s) of the cyan dye image forming layer unit have a silver coating weight less than 50 mg/m$^2$, and an average grain size less than 0.064(μm)$^3$ and comprise means for increasing the speed of the cyan dye image forming unit emulsion(s) to a level sufficient to provide a cyan image having the desired neutral colour balance relationship with the yellow and magenta images formed on exposure and processing.

ADVANTAGEOUS EFFECT OF THE INVENTION

The present invention provides improved granularity in the cyan dye image without loss of speed in the exposed and processed low silver colour print materials.

Additionally the hue of the cyan dye produced is improved in that its half bandwidth is narrowed and unwanted absorptions reduced. It is believed that the improvement in dye hue obtained is because the dye image is formed from a significantly increased number of centres due to the reduction in the grain size (but not the silver coverage) of the emulsion.

BRIEF DESCRIPTION OF THE DRAWINGS

In the accompany drawings

DETAILED DESCRIPTION OF THE INVENTION

Figure 1:
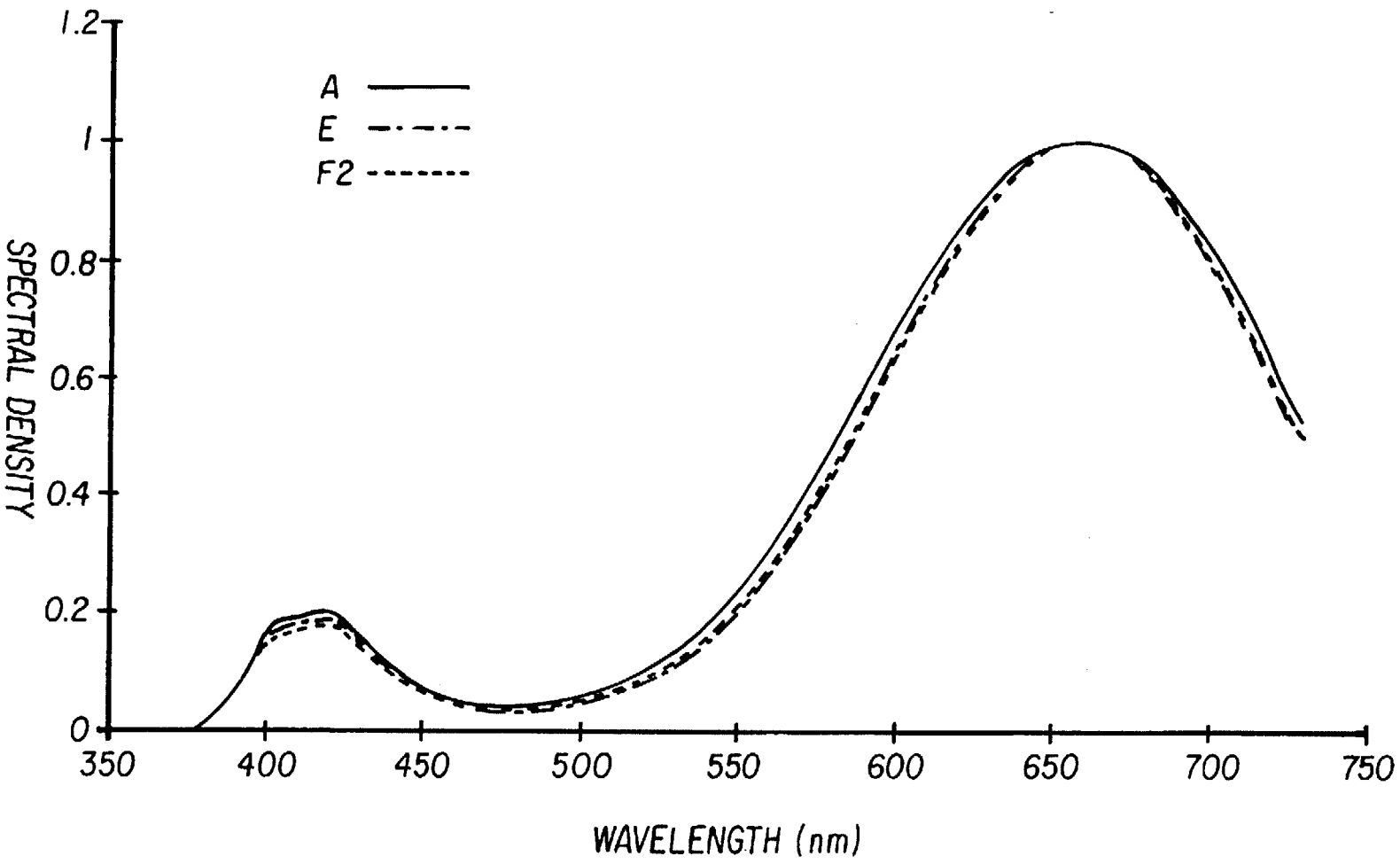
FIG. 1 illustrates the results of Example 1.

At any fixed silver laydown lower granularity can only be achieved by reducing the grain size which results in lower photographic speed. This may result in inadequate speed for practical purposes and compromises the ability to produce a satisfactory colour balance relationship between the dye images.

In the present invention the photographic silver halide colour print material comprises means for increasing the speed of the cyan dye image forming unit emulsion(s) to a level sufficient to provide a cyan image having the desired neutral colour balance relationship with the yellow and magenta images formed on exposure and processing. Such a material will have reduced granularity and improved dye hue.

The neutral balance of the present materials can be assessed by well known techniques including the reproduction of a test object having a neutral step wedge in addition to coloured objects and step wedges.

In order to achieve the desired colour balance the speed of the cyan emulsion(s) may be increased, for example, by using an appropriate sensitising dye or supersensitising dye combination or by using sulphur sensitisation during emulsion preparation.

In one embodiment of the the present invention the speed is increased by sensitising at least one emulsion layer in the cyan dye image-forming layer unit with a combination of a dye of the formula:

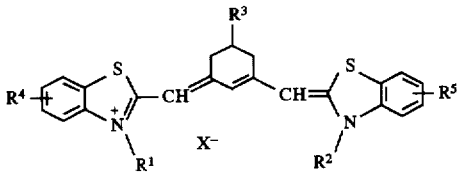

(I)

wherein $R^1$ and $R^2$ are each an alkyl which may be substituted with a sulpho, carboxy or hydroxy group, $R^3$ is hydrogen or an alkyl or aryl group, $R^4$ and $R^5$ are hydrogen or one or more substituents and $X^-$ is a counterion if required, and a compound of the formula:

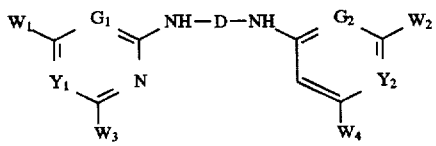

(II)

wherein

D is a divalent aromatic moiety, $W_1$ and $W_2$ are independently a hydrogen or halogen atom or a hydroxy, amino, alkylamino, arylamino, cycloalkylamino, heterocyclicamino, mercapto, alkylthio, arylthio, or aryl group any of which may be substituted, $G_1$ and $G_2$ are each N or CH, $Y_1$ and $Y_2$ are each N or CH provided that at least one of $G_1$ and $Y_1$ is N and at least one of $G_2$ and $Y_2$ is N.

In the above formula (I) the substituents R4 and R5 each preferably comprise groups the sum of whose Hammett $\sigma_p$ values is 0.15 or less. Examples of possible substituents are alkyl, acyl, acyloxy, alkoxycarbonyl, carbonyl, carbamoyl, sulphamoyl, carboxyl, cyano, hydroxy, amino, acylamino, alkoxy, alkylthio, alkylsulphonyl, sulphonic acid, or aryloxy, any of which may be substituted. Additionally, the total J value for the $R_4$ and $R_5$ groups may be less than or equal to 0.10 or 0.0, or even less than or equal to −0.10 where J is the sum of the Hammett $\sigma_p$ values of R4 and R5. Hammett $\sigma_p$ values are discussed in Advanced Organic Chemistry, 3rd Ed., J. March, (John Wiley Sons, NY; 1985). Note that the p subscript refers to the fact that the σ values are measured with the substituents in the para position.

At least one of $R_1$ or $R_2$, or both, are alkyl of 1–8 carbon atoms, either or both of which alkyl may be substituted or unsubstituted. Examples of such substituents include hydroxy or acid or acid salt groups (for example, sulpho or carboxy groups). Thus, either or both $R_1$ and $R_2$ could be, for example, 2-sulfobutyl.

Examples of $R^1$ and $R^2$ are methyl, ethyl, propyl, 3-sulfopropyl, 2-sulphopropyl, 2-sulfoethyl, 4-sulphobutyl, 3-carboxypropyl, 2-carboxybutyl, 4-carboxybutyl, 2-carboxyethyl, 2-hydroxyethyl, or 3-hydroxypropyl.

Examples of $R^3$ are methyl, ethyl, phenyl, tolyl, benzyl.

Examples of substituents $R^4$ and $R^5$ are alkyl, substituted alkyl, aryl, substituted aryl, halo eg Cl or Br.

Examples of X are p-toluene sulphate, chloride, bromide, iodide, and $BF_4^-$.

Preferably the amounts of the Dye of formula (I) and the compound of formula (II) are chosen such that a supersensitising combination (ie one showing a synergistic effect) is formed.

Examples of D formula II are:

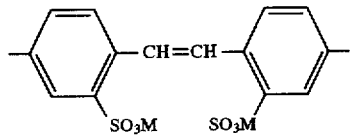

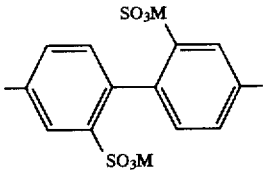

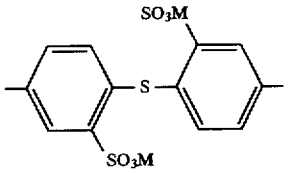

-continued

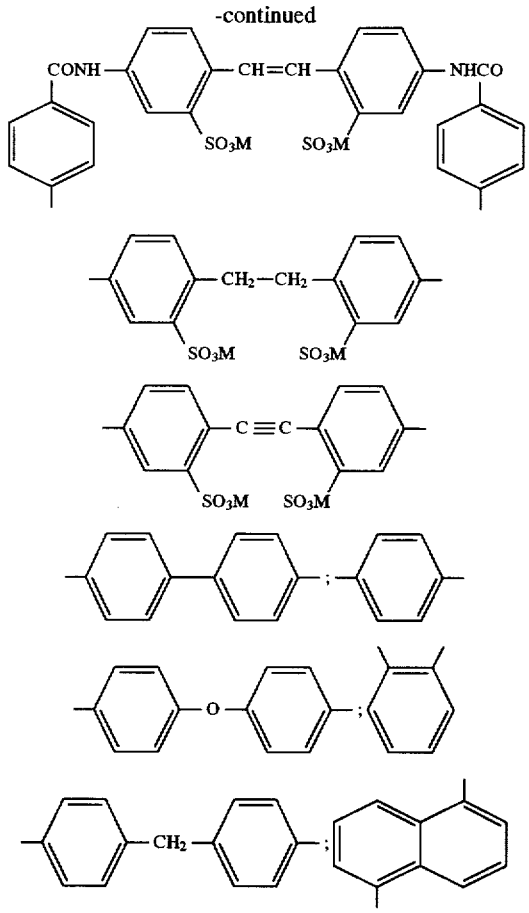

In the above, M is a hydrogen atom or a cation so that water-solubility is increased, eg an alkali metal ion for examples Na or K or an ammonium ion.

Examples of dyes of formula (I) above are shown in the following Table 1.

TABLE 1

| Dye No. | $R^1$ | $R^2$ | $R^3$ | $R^4$ | $R^5$ | $X^-$ |
|---|---|---|---|---|---|---|
| 1 | Et | Et | H | H | H | pts |
| 2 | Me | Me | H | H | H | I |
| 3 | Et | $-(CH_3)SO_3^-$ | H | H | H | — |
| 4 | $-CH_2CH_2OH$ | $-CH_2CH_2OH$ | H | H | H | $Br^-$ |
| 5 | Et | Et | H | Ph | Ph | $I^-$ |
| 6 | Et | Et | H | Cl | Cl | pts |
| 7 | $-(CH3)SO3^-$ | $-(CH_3)SO_3^-$ | H | Ph | Ph | |
| 8 | Et | Et | Me | H | H | $BF_4^-$ |
| 9 | Et | $-(CH_3)SO_3^-$ | Me | H | H | |
| 10 | Et | Et | Ph | H | H | $I^-$ |
| 11 | Et | Et | H | Me | Me | $I^-$ |
| 12 | $-CH_2CH_2OH$ | $-CH_2CH_2OH$ | H | Me | Me | pts |
| 13 | Et | Et | H | Et | Et | $I^-$ |
| 14 | Et | Et | Me | Me | Me | $I^-$ |
| 15 | Et | $-(CH_3)SO_3^-$ | Me | Me | Me | |
| 16 | Et | $-(CH_3)SO_3^-$ | Me | H | H | |

Dyes of formula (I) and the compounds of formula (II) are more fully described in our copending European Application 0 605 917.

Examples of compounds of formula (II) are:

(II-1)

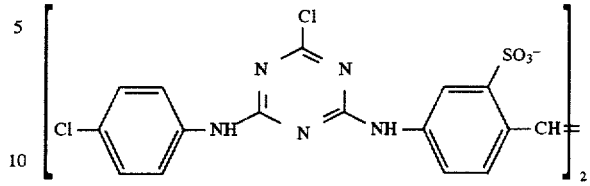

(II-2)

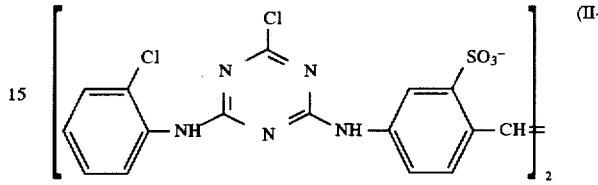

(II-3)

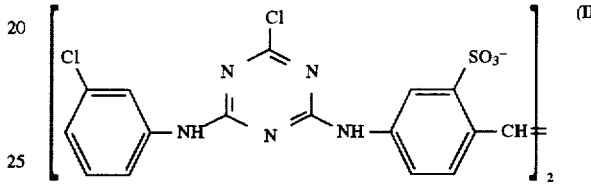

(II-4)

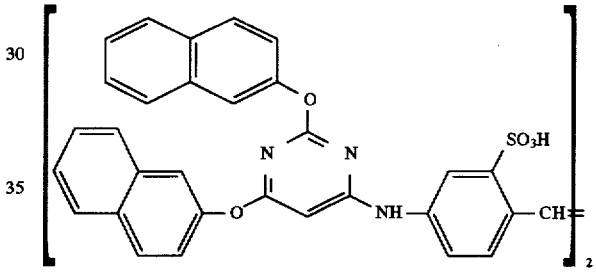

The amount of dye of formula (I) employed is preferably from 1 to $20\times10^{-5}$ particularly from 2.5 to $12\times10^{-5}$ moles/mole silver.

The amount of compound of formula II employed is preferably from 0.5 to $7\times10^{-4}$ particularly from 2.0 to $4\times10^{-4}$ moles/mole silver.

A particular application of this technology is in the processing of silver chloride colour paper, for example paper comprising at least 85 mole percent silver chloride, especially at least 95 mole percent silver chloride. Such emulsions may contain about 2% bromide.

The present silver halide emulsions may be made by methods in themselves known to those in the art. The silver and halide solutions may be introduced into the precipitation vessel in known manner using one or two jets. Double jet precipitation of silver chloride emulsions together with control of pCl and pAg has the advantage that well controlled cubic grains of comparatively uniform size may be formed.

The silver halide grains may be doped with Rhodium, Ruthenium, Iridium or other Group VIII metals either alone or in combination. The grains may be mono-or polydisperse.

The silver halide grains may be, for example, doped with one or more Group VIII metal at levels in the range $10^{-9}$ to $10^{-3}$, preferably $10^{-6}$ to $10^{-3}$, mole metal per mole of silver. The preferred Group VIII metals are Rhodium and/or Iridium.

Preferably the grain size (average volume in cubic microns) of the emulsion(s) of the yellow image forming unit is less than 0.343(μm)$^3$, preferably less than 0.125 (μm)$^3$, and of the magenta image forming unit is less than 0.043(μm)$^3$, preferably less than 0.27(μm)$^3$.

The silver coating weight in the cyan layer of the present photographic materials may be from 5–50 mg/m$^2$, preferably from 5–40 mg/m$^2$ and particularly from 10–25 mg/m$^2$. The preferred grain size for the cyan emulsion layer unit emulsion(s) is from 0.008(μm)$^3$ to 0.043(μm)$^3$ preferably 0.011(μm)$^3$ to 0.033(μm)$^3$.

The total silver coating weight may be in the range 10–150 mg/m$^2$, preferably 30–100 mg/m$^2$ and particularly 40–90 mg/m$^2$.

The silver halide may comprise silver chloride, and is preferably more than 85% chloride, preferably more than 95% chloride, the balance being bromide or iodide or mixtures thereof. Particularly preferred are substantially pure silver chloride emulsions containing a maximum of 2% bromide.

Modifying compounds can be present during grain precipitation. Such compounds can be initially in the reaction vessel or can be added along with one or more of the salts according to conventional procedures. Modifying compounds, such as compounds of copper, thallium, lead, bismuth, cadmium, zinc, sulphur, selenium, tellurium, gold, and Group VIII noble metals, can be present during silver halide precipitation, as illustrated by Arnold et al. U.S. Pat. No. 1,195,432, Hochstetter U.S. Pat. No. 1,951,933, Trivelli et al. U.S. Pat. No. 2,448,060, Overman U.S. Pat. No. 2,628,167, Mueller et al. U.S. Pat. No. 2,950,972, Sidebotham U.S. Pat. No. 3,488,709, Rosencrants et al. U.S. Pat. No. 3,737,313, Berry et al. U.S. Pat. No. 3,772,031, Atwell U.S. Pat. No. 4,20,927, and Research Disclosure, Vol. 134, Jun. 1975, Item 13452.

It is specifically contemplated that grain ripening can occur during the preparation of silver halide emulsion according to the present invention, and it is preferred that grain ripening occur within the reaction vessel during, at least, grain formation. Known silver halide solvents are useful in promoting ripening. Ripening agents can be employed and can be entirely contained within the dispersing medium in the reaction vessel before silver and halide salt addition, or they can be introduced into the reaction vessel along with one or more of the halide salt, silver salt, or peptiser. In still another variant the ripening agent can be introduced independently during halide and silver salt additions. Although ammonia is a known ripening agent, it is not a preferred ripening agent for the emulsions. The preferred emulsions of the present invention are non-ammoniac or neutral emulsions. Among preferred ripening agents are those containing sulphur. Thiocyanate salts can be used, such as alkali metal, most commonly sodium and potassium and ammonium thiocyanate salts. While any conventional quantity of the thiocyanate salts can be introduce preferred concentrations are generally from about 0.1 to 20 grams of thiocyanate salt per mole of silver halide. Illustrative prior teachings of employing thiocyanate ripening agents are found in Nietz et al., U.S. Pat. No. 2,222,264, cited above; Lowe et al. U.S. Pat. No. 2,448,534 and Illingsworth U.S. Pat. No. 3,320,069. Alternatively, conventional thioether ripening agents, such as those disclosed in McBride U.S. Pat. No. 3,271,157, Jones U.S. Pat. No. 3,574,628, and Rosencrants et al. U.S. Pat. No. 3,737,313 can be used.

The preferred silver halide emulsions may have cubic, octahedral or tabular grains and be of comparatively uniform grain sizes. The grains may have volumes in the range 0.001(μm)$^3$ to 1.0(μm)$^3$, preferably 0.0034(μm)$^3$ to 0.22 (μm)$^3$ and particularly from 0.016(μm)$^3$ to 0.064(μm)$^3$.

It will be appreciated that should the same problem occur in the magenta layer unit, for example if a 2-equivalent magenta coupler were to be used, the same technique described herein with regard to the cyan layer unit could be applied to the magenta layer unit to reduce its granularity caused by having too few silver image centres.

The following Examples are included for a better understanding of the invention.

The comparative dye, Dye A had the following formula:

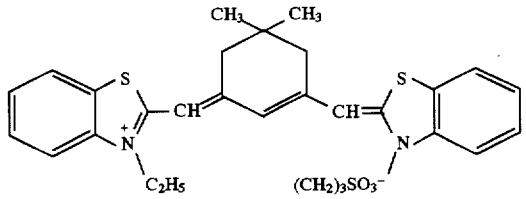

(A)

The emulsions used in the following examples were as outlined below. The dyes used in the present invention are identified in Table 1 above:

A. Optimally sensitised cubic silver chloride of edge length 0.338 micrometers, spectrally sensitised with Dye A (comparative).

B. Optimally sensitised cubic silver chloride emulsion of edge length 0.285 micrometers, spectrally sensitised as follows:
   - B1. Dye A (Comparative).
   - B2. Compound II-1 plus Dye 11 (Invention).
   - B3. Compound II-1 plus Dye 5 (Invention).
   - B4. Compound II-1 plus Dye 9 (Invention).

C. Optimally sensitised silver chloride emulsion of edge length 0.290 micrometers, spectrally sensitised as follows:
   - C1. Dye A (Comparative).
   - C2. Compound II-1 plus Dye A (Comparative).
   - C3. Compound II-1 plus Dye 11 (Invention).
   - C4. Compound II-1 plus Dye 5 (Invention).
   - C5. Compound II-1 plus Dye 9 (Invention).
   - C6. Compound II-1 plus Dye 1 (Invention).

D Optimally sensitised silver chloride emulsion of edge length 0.291 micrometers, spectrally sensitised as follows:
   - D1. Dye A (Comparative).
   - D2. Compound II-2 plus Dye A
   - D3. Compound II-2 plus Dye 11 (Invention).
   - D4. Compound II-2 plus Dye 5 (Invention).
   - D5. Compound II-2 plus Dye 9 (Invention).
   - D6. Compound II-2 plus Dye 1 (Invention).

E. Optimally sensitised cubic silver chloride emulsion of edge length 0.272 micrometers, spectrally sensitised with Compound II-1 plus Dye 5 (invention).

F. Optimally sensitised cubic silver chloride emulsion of edge length 0.256 micrometers, spectrally sensitised as follows:
   - F1. Dye A (Comparative).
   - F2. with Compound II-1 plus Dye 5 (Invention).

The sensitising dye rate used was adjusted for emulsion surface area from a base rate of $3.64\times10^{-5}$ mole/mole Ag for an emulsion of cubic morphology and edge length 0.37 micrometers. Similarly, the rate of II-1 and II-2 employed was adjusted from a base rate of $2.0\times10^{-4}$ mole/mole Ag.

Granularity is derived from granularity noise-power measurements made on a Leitz™ NPS instrument in reflection mode. Aperture granularity values, for an aperture of 560μ diameter, were derived from the NP spectra by application. Sample noise-power spectra (NPS) values (1) were measured with a Status A red filter. Instrument correction NPS values (2) were measured using a stationary scan under the same operating conditions. Corrected NPS values were obtained by subtracting (2) from (1). The corrected NPS was smoothed using a polynomial to get rid of measurement artifacts at low frequencies and the aperture granularity was calculated for a 560 μm diameter circular aperture. This diameter corresponds to viewing at normal distance.

Cyan dye hue in these coatings was monitored by using $\lambda_{1/2}$ (the wavelength in the middle of the spectral absorption band), and HBH (half band-width hypsochromic), which measures the short wavelength side of the half band-width of the spectral absorption curve of the dye).

EXAMPLE 1

Multilayers Processed so that Developed Silver is Retained in Image Dye

Three multilayer colour photographic papers similar to Kodak™ Ektacolor™ paper were coated (5 ins web). Cubic silver chloride emulsions A, E, and F2 were used for the cyan layer at the following silver laydowns (mg/m$^2$): A 15.9; E and F2 13.3. A cubic silver chloride emulsion of edge length 0.45 micrometers was used for the yellow layer of these coatings at a silver laydown of 30.8 mg/m$^2$; similarly an emulsion of edge length 0.256 micrometers was used for the magenta layer at a silver laydown of 20.9 mg/m$^2$. The emulsions were appropriately sensitised with dyes.

A length of each paper was exposed to a four colour wedge (giving red, green, blue and neutral exposures) for 0.1 sec utilising a filter pack containing a Wratten 2B plus 60M plus 60Y CC filters. The exposed coatings were then subjected to redox amplification using the formulation and process sequence shown. In this fix only process (no bleach), developed silver is retained in image dye areas.

Formulation for 1.0 liter of redox amplifier:

| | |
|---|---|
| 1-hydroxyethylidene-1,1'-diphosphonic acid | 0.60 g |
| diethyltriamine-pentaacetic acid | 2.0 ml |
| $K_2CO_3$ | 25.0 g |
| KBr | 1.0 mg |
| KCl | 0.50 g |
| Diethylhydroxylamine sulphate (85%) | 4.0 ml |
| Catechol disulphonate (Na salt) | 0.60 g |
| 4-N-ethyl-N-(β-methanesulphonamidoethyl)-o-toluidine sesquisulphate | 3.5 g |
| pH (27° C.) adj with KOH | 10.3 |
| 100 VOL $H_2O_2$ | 5.0 ml |

Formulation for 1.0 Liter of fix:

| | |
|---|---|
| Glacial acetic acid | 50.0 ml |
| Sodium hydroxide (50%) | 70.0 ml |
| Sodium sulphite | 100.0 g |
| pH | 7.0 |

Process sequence:

| | |
|---|---|
| Develop in a Kodak ™ H11 drum processor 32° C. | 45 sec |
| Fix | 30 sec |
| Wash | 60 sec |

The neutral and cyan separation wedges on the processed material were then read using a densitometer, and sensitometric parameters calculated. These are shown in the Table 2. Dye hue data are given in Table 3 and data for numbers of coated imaging centres and granularity are shown in Table 4.

Density measurements in the Green and Blue represent the unwanted absorptions of the cyan dye when the spectral curves have been normalised to give a Red density, above base, of 1.0.

TABLE 2

| Emulsion | Ag (mg/m$^2$) | Centres ($10^9$) | Green density* | Blue density* | $\lambda_{1/2}$ (nm) | Half Band width (nm) |
|---|---|---|---|---|---|---|
| A | 15.9 | 9.22 | 0.32 | 0.24 | 657.4 | 77.39 |
| E | 13.3 | 14.73 | 0.29 | 0.23 | 658.7 | 72.17 |
| F2 | 13.3 | 17.66 | 0.29 | 0.22 | 656.0 | 71.11 |

TABLE 3

| | Edge | Separation | | | | Neutral |
|---|---|---|---|---|---|---|
| Emulsion | Length* | Dmin | Dmax | Contrast | I-speed | I-speed |
| A | .338 | .113 | 2.58 | 3.81 | 124 | 125 |
| E | .272 | .115 | 2.57 | 3.39 | 137 | 137 |
| F2 | .256 | .116 | 2.60 | 3.69 | 130 | 129 |

*Edge length (micrometers) derived from EGA data

In Table 2 for both Emulsion E and F2, the silver laydown is lower than Emulsion A but the dye half bandwidth and unwanted adsorptions in the green and blue are decreased.

Table 3 shows that both an emulsion of 0.272 edge length and an emulsion of 0.256 edge length, when spectrally sensitised with Dye 1 gave faster speed on neutral and separation exposures than a control emulsion of 0.338 edge length spectrally sensitised with prior art Dye A.

These effects are illustrated in FIG. 1.

TABLE 4

| Emulsion | Edge Length | Ag (mg/m$^2$) | Granularity |
|---|---|---|---|
| A | .338 | 15.9 | 9.8 |
| E | .272 | 13.3 | 7.7 |
| F2 | .256 | 13.3 | 6.8 |

For both Emulsions E and F2, the silver laydown is lower, the Dmax is the same and the granularity is decreased, relative to the control emulsion. Due to the speed increase the colour balance of the material containing Emulsion A is preserved.

EXAMPLE 2

Cyan Single Colour Records

Emulsions B1 to 4, E1 to 2, described above, were coated with an incorporated dispersion of a cyan coupler to give cyan single colour records suitable for redox amplification processing. The silver laydowns used are given in Table 5. The prepared coatings were exposed to step wedge for a time of 0.1 secs. The coatings were processed in a redox amplification process using the redox amplifier formulation and process sequence given below.

Formulation for 1.0 liter of redox amplifier:

| | |
|---|---|
| 1-hydroxyethylidene-1,1'-diphosphonic acid | 0.6 g |
| diethyltriamine-pentaacetic acid | 2.0 ml |
| $K_2CO_3$ | 10.0 g |
| KBr | 1.0 mg |
| KCl | 0.35 g |
| Diethylhydroxylamine (85%) | 4.0 ml |
| 4-N-ethyl-N-(β-methanesulphonamidoethyl)-o-toluidine sesquisulphate | 3.5 g |
| Water to | 1000.0 ml |
| pH (27° C.) adj with KOH to | 10.3 |
| Hydrogen peroxide (100 vol) | 5.0 ml |

Process sequence:

| | |
|---|---|
| Develop in 8 liter tank 32° C. | 45 sec |
| Stop 15 g/l Na metabisulphite | 30 sec |
| Bleach Fix (EKTACOLOR ™ RA4) | 45 sec |
| Wash | 10 min |

The cyan wedges on the processed material were then read using a densitometer, and appropriate sensitometric parameters calculated. These are shown in Table 5.

TABLE 5

| Emulsion | Ag mg/m² | Dmin | Dmax | Contrast | 0.8 Speed | E value |
|---|---|---|---|---|---|---|
| F1 (comp.) | 19.6 | .098 | 2.328 | 3.271 | 97.2 | 119 |
| F2 | 19.6 | .097 | 2.359 | 3.366 | 108.7 | 120 |
| B1 (comp.) | 21.7 | .096 | 2.372 | 3.553 | 102.2 | 109 |
| B2 | 21.7 | .096 | 2.417 | 3.327 | 148.7 | 111 |
| B3 | 21.7 | 0.97 | 2.423 | 3.423 | 155 | 112 |
| B4 | 21.7 | .096 | 2.410 | 3.392 | 147.7 | 111 |

It can be seen that the use of new dye combinations give a speed increase on all emulsion substrates in comparison with the respective comparative emulsions (B1, F1).

EXAMPLE 3

Cyan Single Colour Records

Emulsions C1 to C6, were coated with an incorporated dispersion of a cyan coupler to give cyan single colour records suitable for redox amplification processing. The silver laydowns used are given in Table 3. The prepared coatings were exposed to step wedge for a time of 0.1 secs. The coatings were processed in a redox amplification process as described in Example 2.

The cyan wedges on the processed material were then read using a densitometer, and appropriate sensitometric parameters calculated. These are shown in Table 6.

TABLE 6

| Emulsion | Ag mg/m² | Dmin | Dmax | Contrast | 0.8 Speed | 365 Speed |
|---|---|---|---|---|---|---|
| C1 (comp.) | 22.3. | .114 | 2.442 | 4.028 | 106.2 | 105.0 |
| C2 (comp.) | 22.3 | .109 | 2.393 | 3.849 | 102.5 | 113.0 |
| C3 | 22.3 | .113 | 2.462 | 4.071 | 130.6 | 132.3 |
| C4 | 22.3 | .112 | 2.366 | 3.879 | 128.1 | 132.1 |
| C5 | 22.3 | .113 | 2.497 | 4.182 | 126.6 | 129.3 |
| C6 | 22.3 | .113 | 2.439 | 3.985 | 133.1 | 126.1 |

It can be seen that the use of new dye combinations give a speed increase on all emulsion substrates in comparison with the respective comparative emulsions (C1, C2). It can also be seen that when it is attempted to supersensitise closely related Dye A (sample C2) the speeds obtained were inferior to that obtained by the present invention (C3 to C6).

EXAMPLE

Cyan Single Colour Records Processed so that Developed Silver is Retained in Image Dye Emulsions D1 to D6, as described above, coated with an incorporated dispersion of a cyan coupler to give cyan single colour records suitable for redox amplification processing. The silver laydowns used are given in Table 4. The prepared coatings were exposed to step wedge for a time of 0.1 secs. The coatings were processed in a redox amplification process using the redox amplifier formulation and process sequence given below.

Formulation for 1.0 liter of redox amplifier:

| | |
|---|---|
| 1-hydroxyethylidene-1,1'-diphosphonic acid | 0.6 g |
| diethyltriamine-pentaacetic acid | 2.0 ml |
| $K_2HPO_4.3H_2O$ | 40.0 g |
| Catechol disulphonate | 0.3 g |
| Hydroxylamine sulphate | 1.0 g |
| KBr | 1.0 mg |
| KCl | 0.5 g |
| 4-N-ethyl-N-(β-methanesulphonamidoethyl)-o-toluidine sesquisulphate | 4.5 g |
| Water to | 1000.0 ml |
| pH (27° C.) adj with KOH to | 11.4 |
| Hydrogen peroxide (100 vol) | 2.0 ml |

Process sequence:

| | |
|---|---|
| Develop in 8 liter tank 32° C. | 45 sec |
| Stop 15 g/l Na metabisulphite | 30 sec |
| KODAK ™ C41 fix | 45 sec |
| Wash | 10 min |

The cyan wedges on the processed material were then read using a densitometer, and appropriate sensitometric parameters calculated. These are shown in Table 7.

TABLE 7

| Emulsion | Ag mg/m² | Dmin | Dmax | Constrast | 0.8 Speed |
|---|---|---|---|---|---|
| D1 (comp.) | 16.0 | .172 | 2.504 | 2.785 | 116.5 |
| D2 (comp.) | 16.0 | .151 | 2.483 | 3.612 | 115.8 |
| D3 | 16.0 | .168 | 2.513 | 3.655 | 145.3 |
| D4 | 16.0 | .151 | 2.517 | 3.448 | 139.8 |
| D5 | 16.0 | .168 | 2.521 | 3.668 | 127.7 |
| D6 | 16.0 | .157 | 2.504 | 3.690 | 135.2 |

It can be seen that th e use of new dye combinations give a speed increase on all emulsion substrates in comparison with the respective comparative emulsions (D1, D2).

EXAMPLE 5

Multilayer Coatings

Four multilayer colour photographic papers similar to KODAK™ EKTACOLOR 2001 were coated (sins web). Emulsions B1 and B2 were used for the cyan layer at a silver laydown of 13.3 mg/mn². A cubic silver chloride emulsion of edge length 0.45 micrometers was used for the yellow layer of these coatings at a silver laydown of 30.8 mg/m²;

similarly a silver chloride cubic emulsion of edge length 0.31 micrometers was used for the magenta layers at a silver laydown of 20.9 mg/m$^2$.

A length of each paper was exposed to a four colour wedge (giving red, green, blue and neutral exposures) for 0.1 sec utilising a filter pack containing a WRATTEN™ 2B plus 60M plus 60Y CC filters. The exposed coatings were then subjected to redox amplification using the formulation and process sequence shown.

Formulation for 1.0 liter of redox amplifier:

| | |
|---|---|
| 1-hydroxyethylidene-1,1'-diphosphonic acid | 0.60 g |
| diethyltriamine-pentaacetic acid | 2.0 ml |
| KBr | 1.0 mg |
| KCl | 0.35 g |
| Diethylhydroxylamine (85%) | 4.0 ml |
| Catechol disulphonate (Na salt) | 0.60 g |
| CD3 | 3.50 g |
| $K_2CO_3$ | 25.0 g |
| Demineralised water to | 1000.0 ml |
| pH (27° C.), adj with KOH to | 10.3 |
| 100 VOL $H_2O_2$ | 5.0 ml |

Process sequence (H11 DRUM except where stated):

| | |
|---|---|
| Developer amplifier (32° C.) | 55 sec (H11 DRUM 1) |
| Stop (2% acetic acid) | 30 sec (H11 DRUM 2) |
| Wash | 30 sec |
| Bleach/Fix (EKTACOLOR ™ RA4) | 30 sec (TANK) |
| Wash | 60 sec |

The processed strips were read using an X-Rite™ reflection densitometer and the neutral and separation sensitometric parameters were calculated. The parameters for the cyan layer are shown in Table 8 in which I-Speed means Inertial Speed.

TABLE 8

| Emulsion | | Dmin | Dmax | Contrast | I_Speed | Shoulder | Toe |
|---|---|---|---|---|---|---|---|
| B1 | S | .128 | 2.49 | 3.66 | 104 | 1.95 | .347 |
| (comp.) | N | .124 | 2.59 | 3.64 | 112 | 1.95 | .393 |
| B2 | S | .123 | 2.52 | 3.64 | 151 | 1.95 | .348 |
| | N | 122 | 2.61 | 3.77 | 156 | 2.02 | .342 |

S—Data taken from separation exposures
N—Data taken from neutral exposures

Again, it can be seen that the use of new spectral sensitiser combinations give a significant red speed increase on all emulsion substrates, in comparison with control positions (B1). Colour balance was good providing good neutrals. Not having this speed increase the comparative coatings have a distinct red cast to their neutrals.

What is claimed is:

1. A photographic silver halide color print material comprising a support and yellow, magenta and cyan dye image forming layer units comprising at least one silver halide emulsion layer and at least one dye image-forming coupler which material contains a total silver halide coverage less than 150 mg/$^2$ (as silver) and wherein the grain size (average volume in cubic microns) of the emulsion(s) is less than 1.0(μm)$^3$ in the yellow image forming unit and less than 0.125(μm)$^3$ in the magenta image forming unit and wherein each layer unit of the material has a dye image-forming efficiency (E) of above 30 where:

$$E = \frac{\text{Dye image Dmax}}{\text{Silver coverage (g/m}^2\text{)}}$$

wherein the emulsion(s) of the cyan dye image forming layer unit have a silver coverage less than 50 mg/m$^2$, and an average grain size less than 0.064(μm)$^3$ and comprise means for increasing the speed of the cyan dye image forming unit emulsion(s) to a level sufficient to provide a cyan image having the desired neutral color balance relationship with the yellow and magenta images formed on exposure and processing, and wherein said means for increasing the speed of the cyan dye image forming unit emulsion(s) is selected from:

(a) sulphur sensitisation of the emulsion grains, (b) a spectral sensitising dye or supersensitising combination; and (c) a combination of a dye of formula (I):

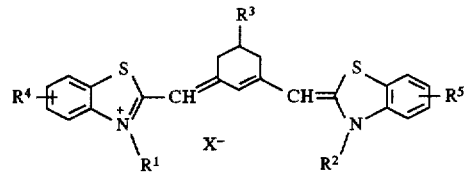

(I)

wherein:

$R^1$ and $R^2$ are each an alkyl which may be substituted with a sulpho, carboxy or hydroxy group;

$R^3$ is hydrogen or an alkyl or aryl group;

$R^4$ and $R^5$ are hydrogen or one or more substituents; and $X^-$ is a counterion if required;

and a compound of formula (II):

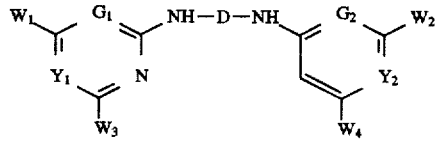

(II)

wherein:

D is a divalent aromatic moiety;

$W_1$ and $W_2$ are independently a hydrogren or halogen atom or a hydroxy, amino, alkylamino, arylamino, cycloalkylamino, heterocyclicamino, mercapto, alkylthio, arylthio, or aryl group any of which may be substituted;

$G_1$ and $G_2$ are each N or CH; and $Y_1$ and $Y_2$ are each N or CH;

provided that at least one of $G_1$ and $Y_1$ is N and at least one of $G_2$ and $Y_2$ is N.

2. A photographic color silver halide material as claimed in claim 1 wherein the the efficiency (E) is determined under conditions that include a color image forming step comprising treatment with a color developing agent with or without redox image amplification.

3. A photographic color silver halide material as claimed in claim 1 wherein the efficiency (E) is determined under conditions that include a color image forming step comprising treatment with a color developing agent and a peroxide redox amplifier.

4. A photographic color silver halide material as claimed in claim 1 wherein the emulsion(s) in the cyan dye image providing layer unit have a grain size below 0.043(μm)$^3$.

5. A photographic color silver halide material as claimed in claim 1 wherein the emulsion(s) in the cyan dye image providing layer unit have a grain size from 0.008(μm)$^3$ to 0.043(μm)$^3$.

6. A photographic color silver halide material as claimed in claim 1 wherein the emulsion(s) in the cyan dye image providing layer unit have a total coating weight from 5–40 $mg/m^2$.

7. A photographic color silver halide material as claimed in claim 1 wherein the speed increasing means comprises sulphur sensitisation of the emulsion grains.

8. A photographic color silver halide material as claimed in claim 1 wherein the speed increasing means comprises a spectral sensitising dye or supersensitising combination.

9. A photographic color silver halide material as claimed in claim 1 in which at least one of the silver halide emulsions in said cyan dye image forming unit is sensitised with a combination of a dye of the formula:

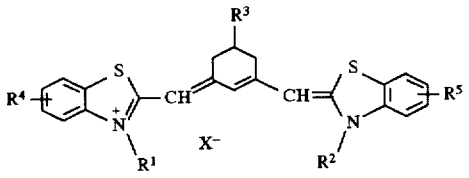

(I)

wherein $R^1$ and $R^2$ are each an alkyl which may be substituted with a sulpho, carboxy or hydroxy group, $R^3$ is hydrogen or an alkyl or aryl group, $R^4$ and $R^5$ are hydrogen or one or more substituents and $X^-$ is a counterion if required, and a compound of the formula:

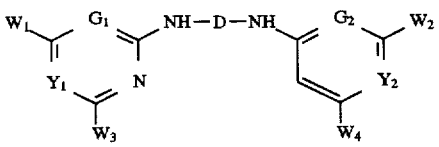

(II)

wherein

D is a divalent aromatic moeity, $W_1$ and $W_2$ are independently a hydrogen or halogen atom or a hydroxy, amino, alkylamino, arylamino, cycloalkylamino, heterocyclicamino, mercapto, alkylthio, arylthio, or aryl group any of which may be substituted, $G_1$ and $G_2$ are each N or CH, $Y_1$ and $Y_2$ are each N or CH provided that at least one of $G_1$ and $Y_1$ is N and at least one of $G_2$ and $Y_2$ is N.

10. A photographic silver halide material as claimed in claim 9 wherein R4 and R5 each comprise groups the sum of whose Hammett σp values is 0.15 or less.

11. A photographic silver halide material as claimed in claim 1 in which the silver halide emulsions comprise at least 85% silver chloride.

12. A photographic silver halide material according to claim 1 further characterised in that the emulsion(s) of the magenta dye forming layer unit have a silver coverage less than 50 $mg/m^2$, an average grain size less than $0.125(\mu m)^3$ and comprise means for increasing the speed of the magenta dye image forming unit emulsion(s) to a level sufficient to provide a magenta image having the desired neutral color balance relationship with the yellow and cyan images formed on exposure and processing.

13. A photographic silver halide material according to claim 12 characterised in that the emulsion(s) of the yellow dye forming layer unit have a silver coverage less than 50 $mg/m^2$, an average grain size less than $1.0(\mu m)^3$ and comprise means for increasing the speed of the yellow dye image forming unit emulsion(s) to a level sufficient to provide a yellow image having the desired neutral color balance relationship with the magenta and cyan images formed on exposure and processing.

* * * * *